US007743782B2

(12) United States Patent
Jost

(10) Patent No.: US 7,743,782 B2
(45) Date of Patent: Jun. 29, 2010

(54) WAVE CONTROL CIRCUIT

(75) Inventor: George Jost, Lake in the Hills, IL (US)

(73) Assignee: Technical Concepts LLC, Mundelein, IL (US)

( * ) Notice: Subject to any disclaimer, the term of this patent is extended or adjusted under 35 U.S.C. 154(b) by 644 days.

(21) Appl. No.: 11/674,479

(22) Filed: Feb. 13, 2007

(65) Prior Publication Data

US 2007/0187635 A1 Aug. 16, 2007

Related U.S. Application Data

(60) Provisional application No. 60/773,504, filed on Feb. 14, 2006.

(51) Int. Cl.
*F16K 31/02* (2006.01)

(52) U.S. Cl. ..... 137/1; 137/624.11; 251/129.04; 4/623

(58) Field of Classification Search ..... 137/624.11, 137/624.12, 1; 251/129.04; 4/623
See application file for complete search history.

(56) References Cited

U.S. PATENT DOCUMENTS

| | | | | |
|---|---|---|---|---|
| 4,683,904 | A * | 8/1987 | Iltis | 137/624.11 |
| 7,069,941 | B2 * | 7/2006 | Parsons et al. | 137/1 |
| 2005/0121529 | A1 | 6/2005 | DeLangis | |
| 2005/0125083 | A1 | 6/2005 | Kiko | |
| 2005/0199842 | A1 | 9/2005 | Parsons et al. | |
| 2006/0006354 | A1 | 1/2006 | Guler et al. | |

OTHER PUBLICATIONS

International Search Report mailing date Feb. 20, 2008.
Inernational Searching Authority, International Preliminary Report on Patentability, Aug. 28, 2008.

* cited by examiner

*Primary Examiner*—Kevin L Lee
(74) *Attorney, Agent, or Firm*—Dennis J. Williamson; Moore & Van Allen, PLLC

(57) ABSTRACT

A wave control circuit disclosed herein may be used to control the operation of various plumbing devices and appliances. The wave control circuit uses a sensor to sense presence of objects in the vicinity of the plumbing device and appliance using the wave control circuit and a control circuit to control the operation of the plumbing device or appliance.

17 Claims, 5 Drawing Sheets

WAVE CONTROL CIRCUIT

CROSS-REFERENCE TO RELATED APPLICATIONS

This application is based on and claims the benefit of U.S. Provisional Application No. 60/773,504, filed on Feb. 14, 2006 and entitled "Wave Control Circuit for Plumbing Devices and Appliances," which is incorporated herein by reference in its entirety.

BRIEF DESCRIPTION OF THE DRAWINGS

The features and inventive aspects of the present invention will become more apparent upon reading the following detailed description and drawings. In the drawing figures, which are merely illustrative, and wherein like reference numerals depict like elements throughout the several views.

DETAILED DESCRIPTION

The present invention relates to a wave control circuit used to control the operation of various plumbing devices and appliances. An illustrative embodiment of the invention is described herein, with reference to the accompanying drawing figures. A person having ordinary skill in the art will recognize that the invention may be practiced in a variety of orientations without departing from the spirit and scope of the invention.

Figure 1:
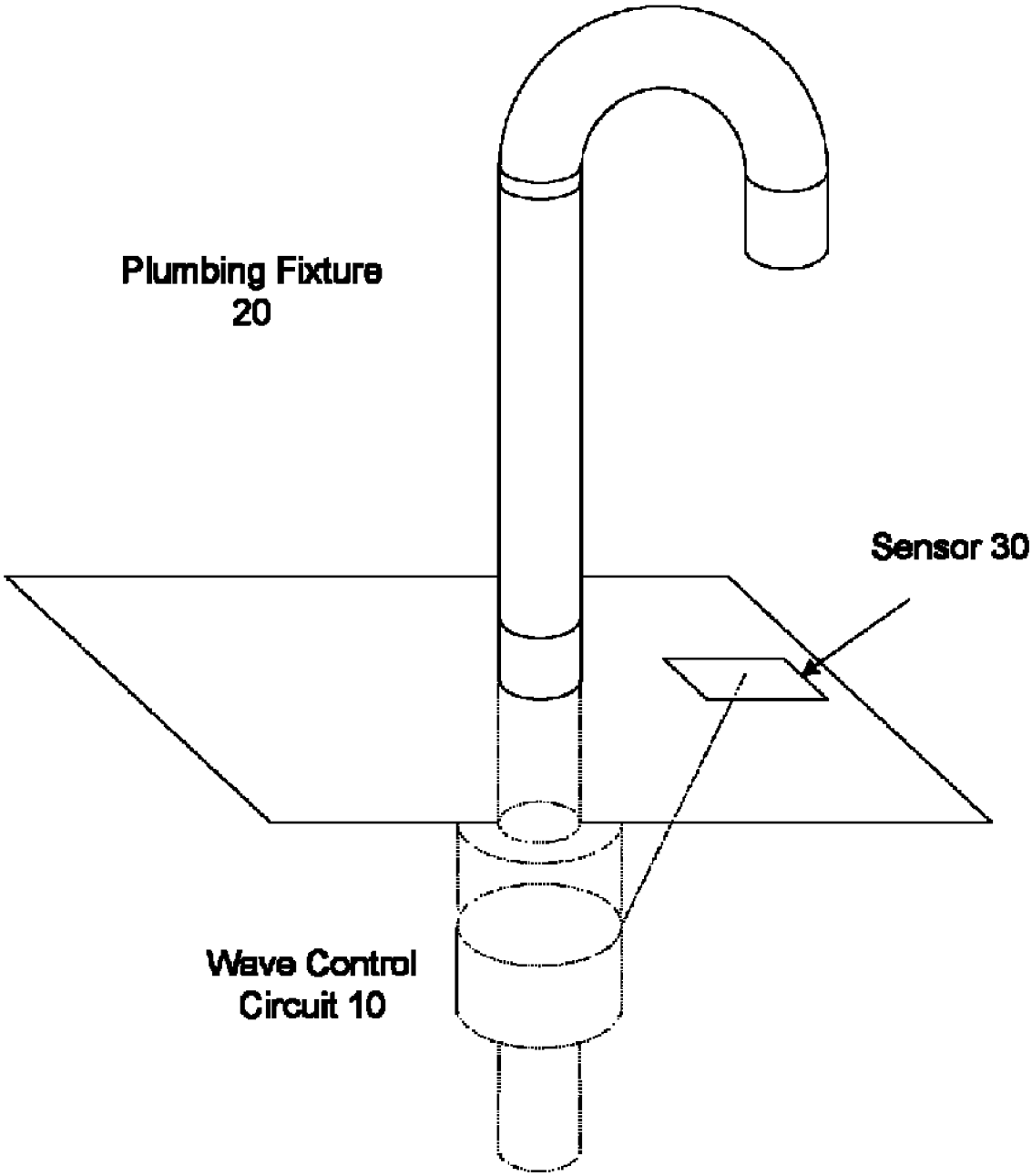
FIG. 1 is an is an assembly view of a plumbing fixture and wave control circuit system formed in accordance with the teachings of this invention.
Figure 2:
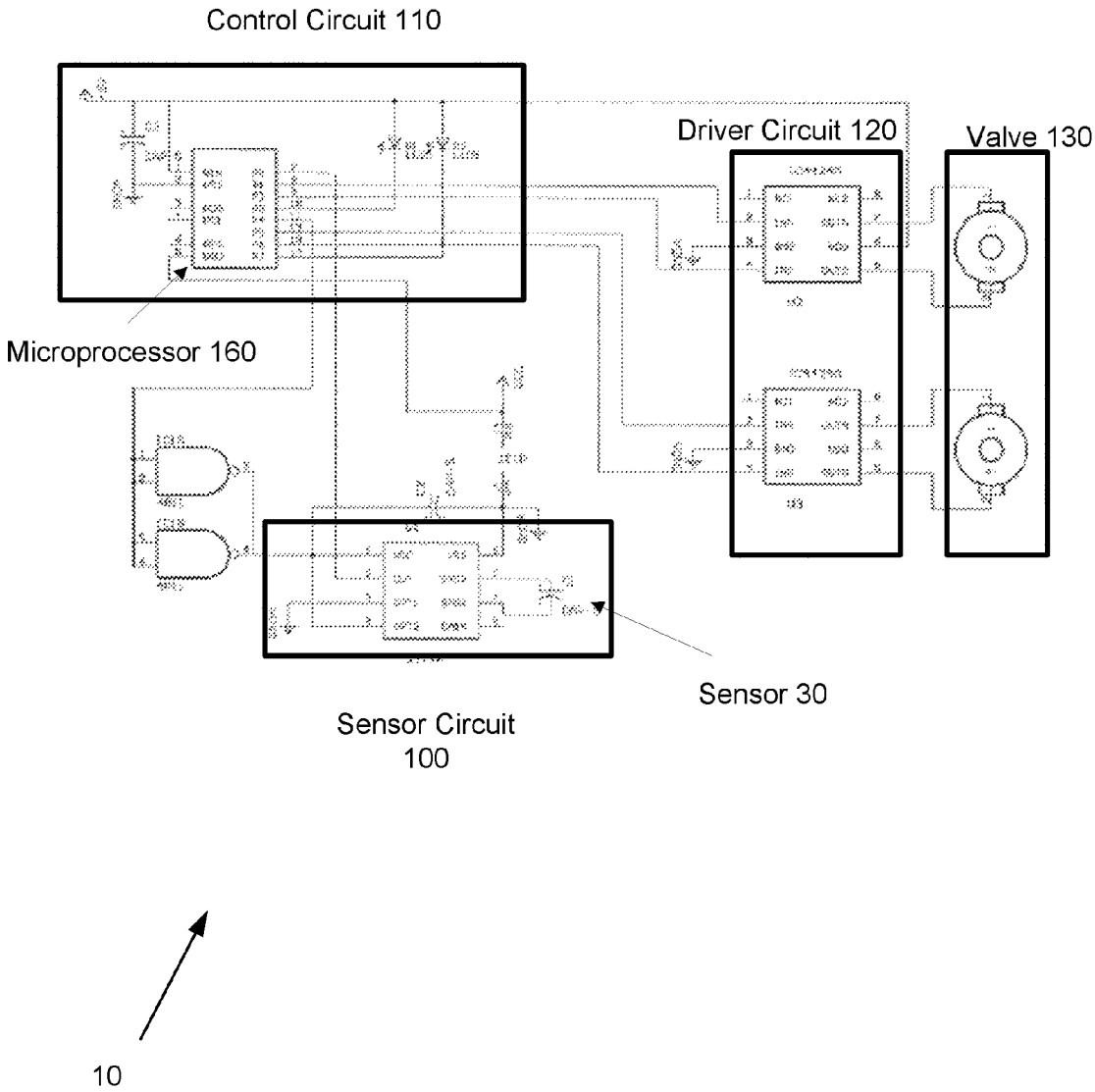
FIG. 2 shows a wave control circuit for the system shown in FIG. 1.

FIG. 1 shows an illustrative embodiment of the invention used to control the operation of a plumbing device such as a faucet. The embodiment of the invention consists of a wave control circuit 10, a plumbing device 20 and at least one sensor 30. Alternatively, all or a portion of the plumbing device 20 may comprise the sensor 30. As best seen in FIG. 2, the wave control circuit 10 may include at least one sensor circuit 100, at least one control circuit 110, at least one driver circuit 120, at least one valve 130, and at least one sensor 30 associated with the plumbing device 20. Control circuit 110 may comprise digital logic circuitry or a microprocessor 160 that executes software instructions built into the microprocessor 160.

In either case, control circuit 110 reads output from sensor circuit 100 to control the flow of fluid through plumbing device 20. Control circuit 110 sends an output signal through driver circuit 120 to control the flow of fluid through plumbing device 20. Driver circuit 120 achieves the proper drive voltage and current necessary to enable or disable valve 130. Valve 130 enables and disables functions of plumbing device 20. For example, when valve 130 is open, fluid such as water may flow through plumbing device 20, which is shown in FIG. 1 as a faucet.

Now referring to FIG. 2, the wave control circuit 10 is shown to include a sensor circuit 100, a control circuit 110, and a driver circuit 120. The wave control circuit 10 may be communicatively connected to the valves 130. As best seen in FIG. 2, the sensor circuit 100 may include a capacitive sensing network that is connected to proximity sensor 30. The proximity sensor 30 may detect the presence of objects placed within the sensor's sensing field by capacitive charging and discharging. Therefore, when an object is placed within the sensing field of the proximity sensor 30, the proximity sensor 30 is charged with a potential voltage and then discharged when the object is moved away. When the proximity sensor 30 is discharged, a small current or a voltage drop may be produced and the sensor circuit 100 may detect such a voltage drop. An example of proximity sensor used in such an application may be what is generally referred to as a charge transfer sensor. However, a person having ordinary skill in the art will understand that this is but only one example of the proximity sensor 30 that may be used in the application and other types of sensors may be used to perform the equivalent function.

Typically charge transfer sensors are used to detect objects in free space; thus, a very low capacitance field is generally present. However, the presence of running water may change the impedance of the capacitance network and, thus, may change and affect the sensitivity of sensor circuit 100. To adjust for this possibility, the sensor circuit 100 is put through a recalibration procedure by either power cycling the sensor circuit 100 or engaging a recalibration function of the sensor circuit 100 to adjust to the load impedance presented to the circuit when the water flows. The recalibration accounts for the changed operating conditions and allows the sensor circuit 100 to have identical sensitivity when water is flowing or isn't flowing through the plumbing device 20. A person having skill in the art will appreciate that a slight delay may be included before the recalibration. This delay may help to assure that impedance is accurately sensed or measured by the sensor circuit 100.

Figure 3:
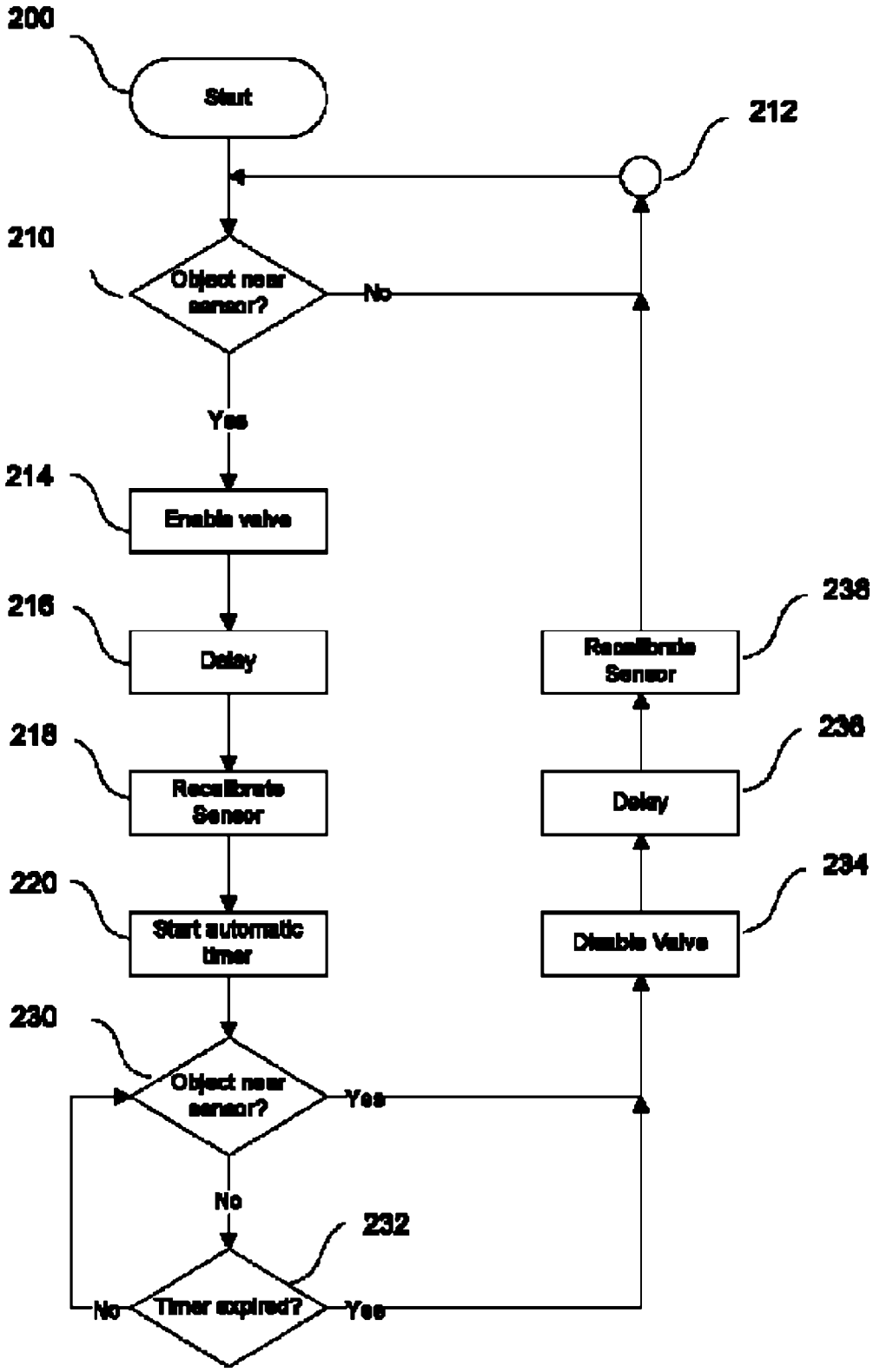
FIG. 3 is a flow diagram for the system shown in FIG. 1.
Figure 4:
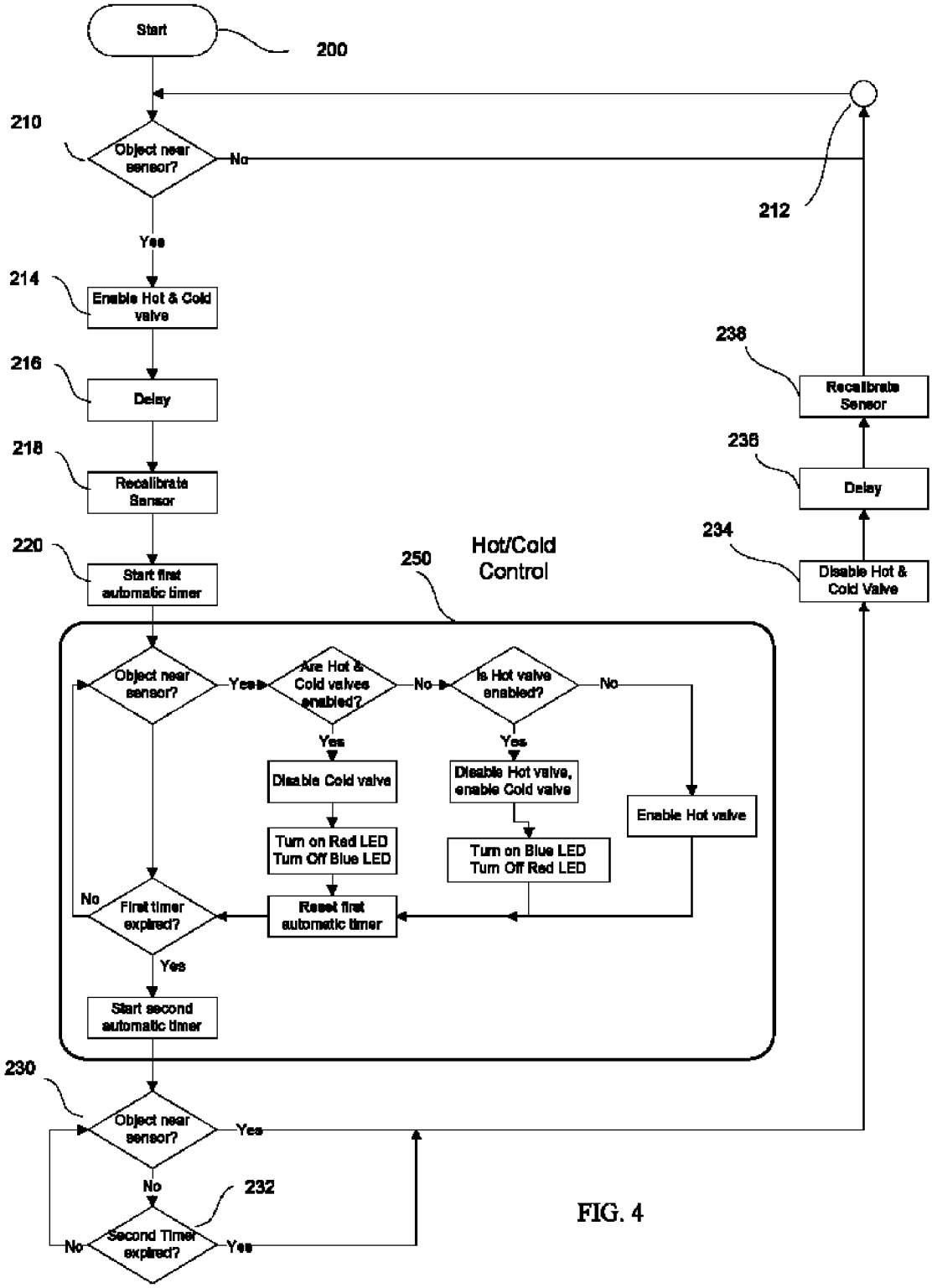
FIG. 4 illustrates an alternate logic flow diagram for the system shown in FIG. 1.
Figure 5:
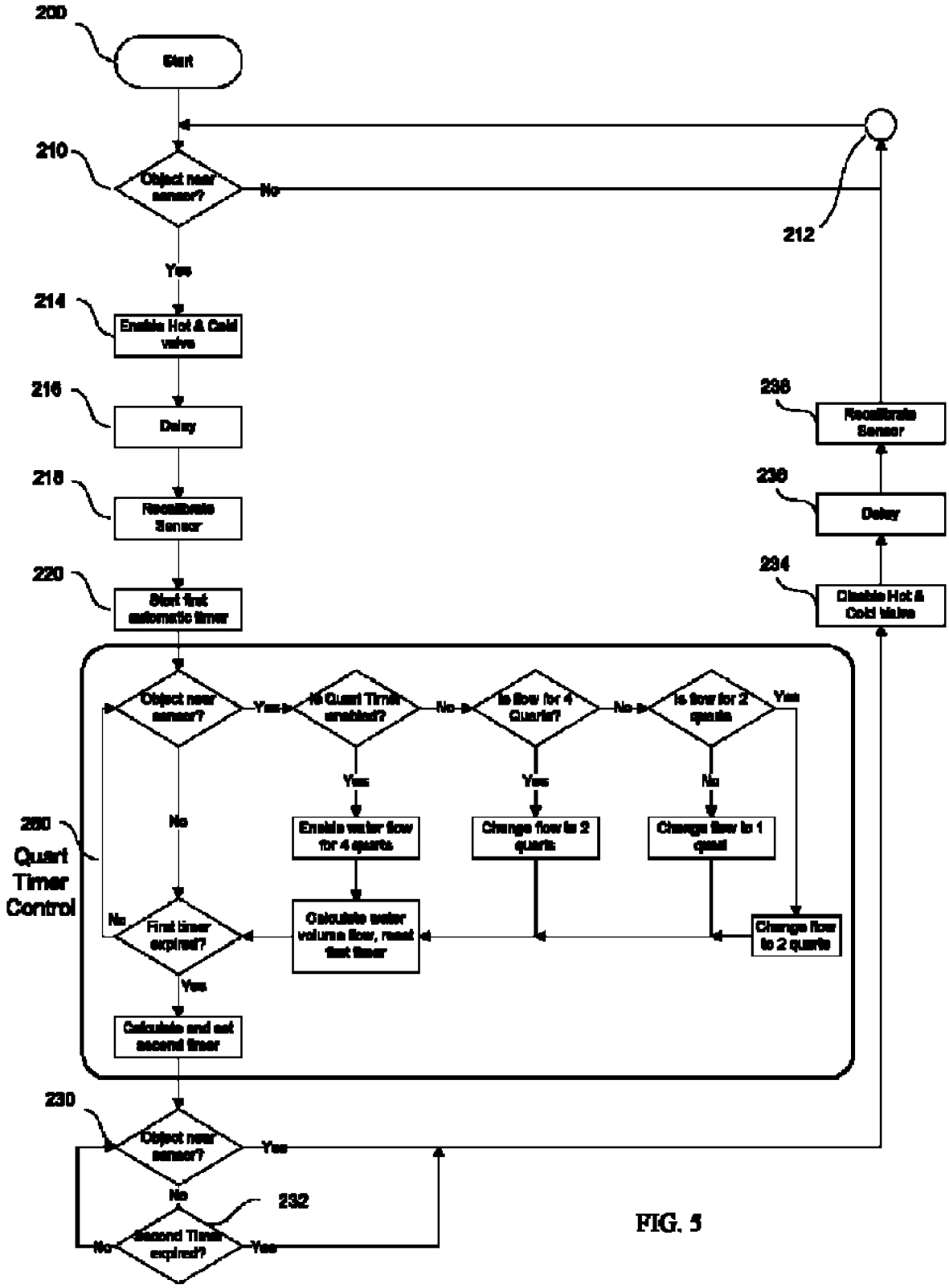
FIG. 5 shows still another alternate logic flow diagram for the system shown in FIG. 1.

The control circuit 110 may consist of discrete components such as a sequence of flip-flops, a clock, and logic gates to perform the functions described in FIGS. 3-5. In an embodiment of the wave control circuit 10, the control circuit 110 may further include a control logic circuit and a timer circuit. Upon a successful signal (i.e., detection of an object) from sensor 30, sensor circuit 100, which is connected to the control logic circuit, may output a high state. The high state of control logic circuit may trigger the timer circuit to create a timing event. Such timing event may enable the driver circuit 120, which subsequently enables or disables valve 130. The timing event may also be used to recalibrate the sensor circuit 100 while the sensor circuit 100 maintains its high output state. The high output state of the sensor circuit 100 may be maintained until a second signal from the sensor 30 is detected. Such second detection may set the output state of sensor circuit 100 to low, which may create another timing signal that disables valve 30 and resets sensor circuit 100.

FIG. 3 represents one possible logical flow for the operation of a hands-free plumbing device such as a faucet. In such an embodiment, the plumbing device 20 may use the proximity sensor 30 of the circuit 100. As shown in FIG. 3, the control circuit 110 initializes at step 200. At 210, the proximity sensor 30 may determine if an object has been placed within a predetermined proximity to faucet 20. If it is determined that no object is within the sensing field of proximity sensor 30, the process loops to point 212 and repeats step 210. When an object is found within the sensing field of proximity sensor 30, the logical control 110 may enable the valve 130 to start the flow of water at step 214. After a short delay at step 216, the proximity sensor 30 may be recalibrated at step 218 and the logic control 110 may start a first automatic timer at step 220.

At step 230, the proximity sensor 30 may determine if an object has been placed in proximity to the faucet 20. If no object is detected within the sensing field of the proximity sensor 30, the process loops to point 232 to determine if the first automatic timer has expired. If the automatic timer has not expired, the logical control 110 loops back to step 230. If the automatic timer has expired or an object is found within the sensing field of proximity sensor 30, the logical control 110 proceeds to step 234 and disables the valve 130, stopping the flow of water. After a short delay at step 236, the logical control 110 moves to point 238 and recalibrates the proximity sensor 30. Subsequently, the logical control 110 proceeds to the point 212.

A person having ordinary skill in the art will understand that the logical flow of the embodiment of the invention may be modified to incorporate additional features. One such alternate logical flow is described in FIG. 4, which discloses a hands free mode to control the water temperature of a plumbing device. As illustrated in FIG. 4, at step 214, the embodiment of the system is modified to include a hot valve and a cold valve, both of which may be enabled or disabled by logic control 110 or another similar control device or circuit. For example at step 220, a first timer may be started. The hot/cold control shown at step 250 enables and disables the hot and cold valves to control the water temperature. The initial state of the hot/cold control is the warm state. In the illustrated embodiment, the first timer controls the period on which the hot/cold control is active. This permits the user to cycle through the temperature states and select a desired water temperature.

In the warm state, both the hot valve and the cold valve are enabled, resulting in a mixture of hot and cold water flowing to the plumbing device. The volume of hot and cold water flowing to the plumbing device may be selectively varied, thus, resulting in the ability to selectively control the water temperature.

For a period of time established by first automatic timer at step 200, the proximity sensor 30 may attempt to detect objects within the sensor's sensing field. Successful detection of an object causes the hot/cold control shown at step 250 to cycle through several temperature states. The hot/cold control, shown at step 250, cycles through the warm state, the hot state, and finally the cold state. After changing the state of the hot/cold control at step 250, the first automatic timer may be reset. When the time period set by first automatic timer expires, the hot/cold control may be disabled and the water temperature cannot be changed. The water flow will then be disabled by either the detection of an object within the sensing field of proximity sensor 30 or the expiration of a time period set by a second automatic timer. If the temperature is changed during the first auto timer period, an appropriate LED may be lit to indicate the water temperature chosen. For example a red LED may be lit to indicate hot temperature and a green LED may be lit to indicate cooler temperature. Such an LED can be on constantly or may be blinking at a rapid rate. When the first auto timer period ends, and the water temperature cannot be changed, the LED may go off or may become a less often blinking indicator (lower duty cycle) to conserve energy. When the water is off, the LED may also be completely off.

Now referring to FIG. 5, another feature of the invention may be a quarts timer control. Such an embodiment may include a regulator to control the flow of the water. In this embodiment, for a period of time, proximity sensor 30 attempts to detect objects within the sensing field to enable the quarts timer control, step 260. Once enabled, a user may use the quarts timer control to set the volume of water to be dispensed to a predetermined volume, e.g., 1 quart, 4 quarts, etc. The quarts timer control may also calculate the volume of water that has already flowed and finally reset the first automatic timer.

On subsequent detections while the first automatic timer is active, the quarts timer control cycles through water volume to be dispensed and adjusts the regulator accordingly. At the expiration of the time period set by the first automatic timer, the quarts timer control calculates the time required for the desired volume of water to be dispensed and starts the second automatic timer. The flow of water is disabled by either the detection of an object within the sensing field of proximity sensor 30 or the expiration of the time period set by the second automatic timer.

Another embodiment of the system may optionally be a hands free bathtub faucet and shower-head. Such an embodiment may include proximity sensors in both the faucet and the shower-head. The successful detection of an object within the sensing field of the proximity sensor of either the faucet or the shower head may accordingly enable the flow of water in the appropriate plumbing device. If the activated plumbing device detects an object within the sensing field of the proximity sensor, the plumbing device may accordingly disable the flow of water. However, if the disabled plumbing device detects an object within the sensing field of its proximity sensor, the active plumbing device will be disabled and the next plumbing device will be activated.

While the description above refers to particular embodiments of the present invention, it will be understood that many modifications may be made without departing from the spirit thereof. The accompanying claims are intended to cover such modifications as would fall within the true scope and spirit of the present invention. The presently disclosed embodiments are therefore to be considered in all respects illustrative and not restrictive, the scope of the invention being indicated by the appended claims, rather than the foregoing description, and all changes which come within the meaning and range of equivalency of the claims are therefore intended to be embraced therein.

What is claimed is:

1. An apparatus for controlling operation of a plumbing device, the apparatus comprising:

a sensor device adapted to detect movement of an object in its sensing field and to generate a sensing signal;

a control circuit adapted to:

generate a timing event in response to the sensing signal, generate an enabling signal to enable a valve in response to the timing event, calibrate the sensor device after a delay following the enabling of the valve, determine if the valve needs to be disabled by starting an automatic timer after calibrating the sensor, and at least one of determining if there is an object near the sensor and if the timer has expired, and generate a disabling signal to disable the valve.

2. The apparatus of claim 1, wherein the plumbing device is at least one of a faucet and a showerhead.

3. The apparatus of claim 1, wherein calibrating the sensor device further comprises calibrating the sensor device to account for a flow of fluid.

4. The apparatus of claim 3, wherein the control circuit is adapted to generate enabling and disabling signals for a hot valve and a cold valve.

5. The apparatus of claim 4, wherein the control circuit is further adapted to control the hot valve and the cold valve in a manner so as to cycle the flow of fluid from the plumbing device through a warm state, a hot state and a cold state in a predetermined order.

6. The apparatus of claim 5, wherein the control circuit is further adapted to turn on at least one of a red LED and a blue LED based on a temperature of the fluid.

7. The apparatus of claim 5, wherein the control circuit is further adapted to select at least one of the warm state, the hot state and the cold state upon detection of an object near the sensor.

8. The apparatus of claim 3, wherein the control circuit is further adapted to control a volume of fluid dispensed through the plumbing device.

9. The apparatus of claim 8, wherein the control circuit is further adapted to set the volume of fluid from the plumbing device through a number of pre-determined volume levels.

10. The apparatus of claim 9, wherein the control circuit is further adapted to select one of the number of pre-determined volume levels based on detection of an object near the sensor.

11. A method of controlling operation of a plumbing device, the method comprising:

detecting movement of an object in sensing field of a sensor to generate a sensing signal;

generating a timing event in response to the sensing signal;

generating an enabling signal to enable a valve in response to the timing event;

calibrating the sensor device after a delay following the enabling of the valve;

determining if the valve needs to be disabled by starting an automatic timer after calibrating the sensor; and at least one of determining if there is an object near the sensor and if the time has expired; and generating a disabling signal to disable the valve.

12. The method of claim 11, wherein the plumbing device is at least one of a faucet and a showerhead.

13. The method of claim 12, further comprising controlling a hot valve and a cold valve in a manner so as to cycle a flow of fluid from the plumbing device through a warm state, a hot state and a cold state in a predetermined order.

14. The method of claim 13, further comprising turning on at least one of a red LED and a blue LED based on a temperature of the fluid.

15. The method of claim 12, further comprising controlling a volume of fluid dispensed through the plumbing device.

16. The method of claim 15, further comprising setting the volume of fluid from the plumbing device through a number of pre-determined volume levels.

17. The method of claim 16, further comprising selecting one of the number of predetermined volume levels based on detection of an object near the sensor.

* * * * *